US006816668B2

(12) United States Patent
McDonald et al.

(10) Patent No.: US 6,816,668 B2
(45) Date of Patent: Nov. 9, 2004

(54) PHASE SHIFTER HAVING DIFFERENTLY SHAPED INTERACTIVE ELEMENTS AND AN ANTENNA SYSTEM FORMED THEREFROM

(75) Inventors: Noel McDonald, Croydon (AU); Charlie G. Williams, Ferntree Gully (AU)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/003,071

(22) Filed: Dec. 6, 2001

(65) Prior Publication Data

US 2002/0089394 A1 Jul. 11, 2002

(30) Foreign Application Priority Data

Dec. 8, 2000 (AU) ..... PR1963

(51) Int. Cl.[7] ..... H01P 1/18
(52) U.S. Cl. ..... 392/375; 393/853; 333/161
(58) Field of Search ..... 333/161, 156; 342/375; 343/853

(56) References Cited

U.S. PATENT DOCUMENTS 5,905,462 A * 5/1999 Hampel et al. ..... 333/161 X
5,940,030 A * 8/1999 Hampel et al. ..... 333/161 X
6,075,424 A 6/2000 Hampel et al.
6,441,700 B2 * 8/2002 Xu ..... 333/161

FOREIGN PATENT DOCUMENTS

AU B-41625/93 1/1994
DE 19911905 A1 10/1999

* cited by examiner

*Primary Examiner*—Benny T. Lee
(74) *Attorney, Agent, or Firm*—Sughrue Mion, PLLC

(57) ABSTRACT

A phase shifter element for selectively varying the phase of signals of desired frequencies or frequency range passing through an adjacent transmission line associated with, for example, an antenna array to electrically down-tilt the array's electromagnetic wave pattern. The phase shifter element comprises a planar dielectric member having at least three discrete coplanar interactive segments extending from an edge thereof and arranged to movably overlap the adjacent transmission line to vary its dielectric constant. Optimum dimensions of each interactive segments and optimum widths of gaps defined by opposite edges of adjacent segments being determined by a computer optimisation program, such that the phase shifter element achieves a wide operating frequency and minimum aggregate reflection.

21 Claims, 7 Drawing Sheets

PHASE SHIFTER HAVING DIFFERENTLY SHAPED INTERACTIVE ELEMENTS AND AN ANTENNA SYSTEM FORMED THEREFROM

FIELD OF INVENTION

This invention relates to antennas and in particular to an arrangement to electrically down-tilt the electromagnetic wave pattern associated with a transmit antenna array, or electrically re-orient a receive antenna array.

BACKGROUND OF INVENTION

It is sometimes desirable to adjust the orientation of the electromagnetic wave pattern of a transmit antenna array, particularly a downward adjustment, typically 0 degrees to 15 degrees below horizontal, when the antenna is located at a higher altitude than other antennas that communicate with the transmit antenna array. The downward adjustment of the radiation pattern alters the coverage area and may enhance communication with mobile users situated in shadowed areas below the transmit antenna array.

Besides actually mechanically tilting the entire antenna assembly, it is known to electrically down-tilt the radiation pattern by controllably varying the relative phase or phases between two or more radiating elements of the antenna array.

One known method by which the relative phase between two or more radiating elements can be change to change the relative lengths of respective transmission lines connecting the antenna's common feed point to each element of the antenna array. Typically, various predetermined lengths of jumper cable are provided which are selectively connected between the common feed and each element to obtain a desired down-tilt. The jumper cables include co-axial connectors to facilitate connection. Furthermore, if stripline is used to connect the common feed point to the respective elements of the antenna array, some form of transition means is required to couple the jumper cable's coaxial connections to the stripline. A disadvantage of this known method is that it is expensive, unreliable and susceptible to the generation of intermodulation products.

Another known method by which the relative phase between two or more radiating elements can be changed is to change the propagation velocity of the transmission line connecting the common feed point to at least some of the elements of the antenna array. Typically, this latter method is achieved by selectively changing the dielectric constant of the transmission line dielectric. If the transmission line is in the form of a conductive strip, the propagation velocity thereof is changed by introducing a dielectric material between the strip and its associated ground plane.

It is, however, well understood that the introduction of dielectric material under such a conductive strip causes the strip's normal impedance to be disturbed. For example, if a conductive strip having a certain width is spaced above a ground-plane at a certain distance such as to present a 50 ohm impedance, the introduction of a dielectric material between the conductive strip and the ground-plane will reduce the value of this impedance to a value that depends upon the effective dielectric constant of the dielectric material. The resulting impedance mismatch would cause a degradation of return-loss performance of the antenna.

Australian Patent No. 664625 discloses an arrangement of an adjustable phase shifter comprising dielectric phase shifter elements moveably interposed between conductive strips that couple radiating elements, and a common ground-plane. The phase shifter elements are of a characteristic configuration which avoids disturbing the normal impedance during adjustment. This known arrangement, however, requires that respective phase shifter elements be located between each active strip and the conductive ground-plane. Such an arrangement imposes constructional disadvantages as well as limitations to the range of phase shift produced, which consequently imposes limits to the range of tilt.

Australian Patent Application No. 14278/99 discloses an arrangement of an adjustable phase shifter comprising a transmission line in the form of a printed circuit board supporting conductive tracks on one side thereof, and a ground-plane spaced below the other side thereof. A moveable dielectric element is arranged adjacent the conductive tracks. The moveable dielectric element is provided with a plurality of teeth along opposite edges for selectively overlapping the conductive tracks. This arrangement provides an adjustable phase shifter having stable impedance characteristics and a relatively large phase shift as compared with the prior art.

New radio frequency bands have been allocated to provide more channels for the rapidly increasing cellular mobile telephone usage. Instead of having separate base station antennas for different bands, it is desirable to provide multiple-band antennas. For example, it may be desirable to combine the 1710–1880 MHz DCS band with the 1920–2170 MHz UMTS band, with an overall bandwidth of 460 MHz, which is wider than previous systems. In order to electrically down-tilt the radiation pattern of such a multiple band antenna, a phase shifter is required that has a wider frequency range than the aforementioned prior art phase shifter arrangements can accomplish.

SUMMARY OF INVENTION

It is an object of the present invention to provide an adjustable radio frequency phase shifter arrangement having a wider operating frequency range than prior art arrangements.

According to the invention there is provided a phase shifter element arranged to selectively vary the effective dielectric constant of a section of transmission line thereby changing the propagation velocity of the transmission line and varying the phase of signals of desired frequencies or frequency range passing through the transmission line the phase shifter element comprising a movable planar dielectric member of predetermined dielectric constant adjacent the transmission line, the planar dielectric member being provided with three or more discrete interactive dielectric segments extending from at least one edge thereof to moveably overlap the adjacent transmission line, where optimum dimensions of each interactive segment and optimum widths of gaps defined by opposite edges of adjacent segments are determined by computer optimisation means, such that the aggregate reflection of the signals passing through the transmission line is minimised.

The present invention is based on the concept that, as phase shift is generally proportional to the length of added or inserted dielectric, if the total dielectric length required for one particular phase shift is broken up into a plurality of segments, then it is possible to optimise all of the lengths and spacings of those segments in such a way as to reduce the aggregate reflection at several frequencies, or over a range of frequencies. Thus for a specified frequency range and for one required electrical phase shift, computer optimisation is used to determine the optimum lengths of a plurality of dielectric segments and the spacings between them. The same procedure is repeated for other phase shift values to produce an optimum profile for the movable dielectric element.

In order that the invention may be readily carried into effect, embodiments thereof will now be described in relation to figures of the accompanying drawings, in which:

DETAILED DESCRIPTION OF THE EXEMPLARY EMBODIMENTS

Figure 1:
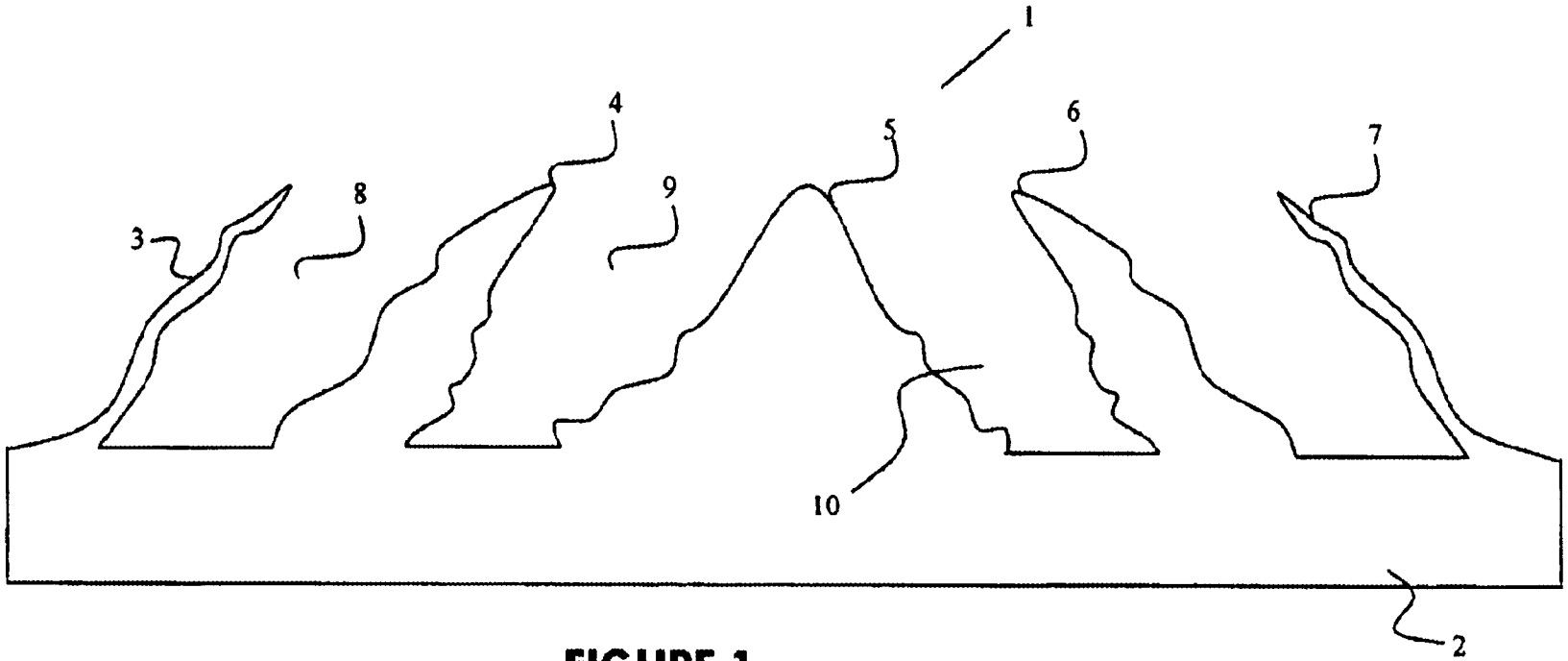
FIG. 1 is a plan view of a planar dielectric element provided with a plurality of characteristic spaced segments extending therefrom.
Figure 2:
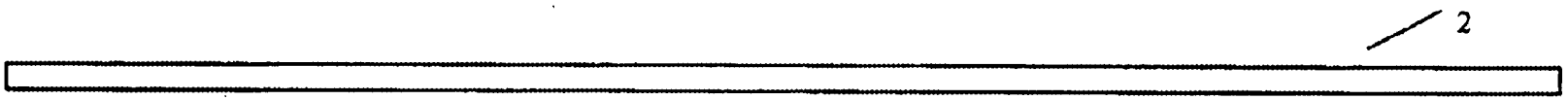
FIG. 2 is a side view of FIG. 1.

Referring to FIG. 1 of the drawings there is shown a planar dielectric element 1 comprising a rectangular body section 2 (see also FIG. 2) and five segments, 3, 4, 5, 6 and 7 extending from a major edge of body section 2. The segments are separated by four air gaps 8, 9, 10 and 11. The segments lie in the same plane as the body section. To improve structural rigidity of the dielectric element, the air gaps may be replaced by a dielectric material of a different dielectric constant to that of the material of the dielectric element 1. Alternately, the air gaps may be replaced by thinner portions of the same material as the dielectric element.

Figure 3:
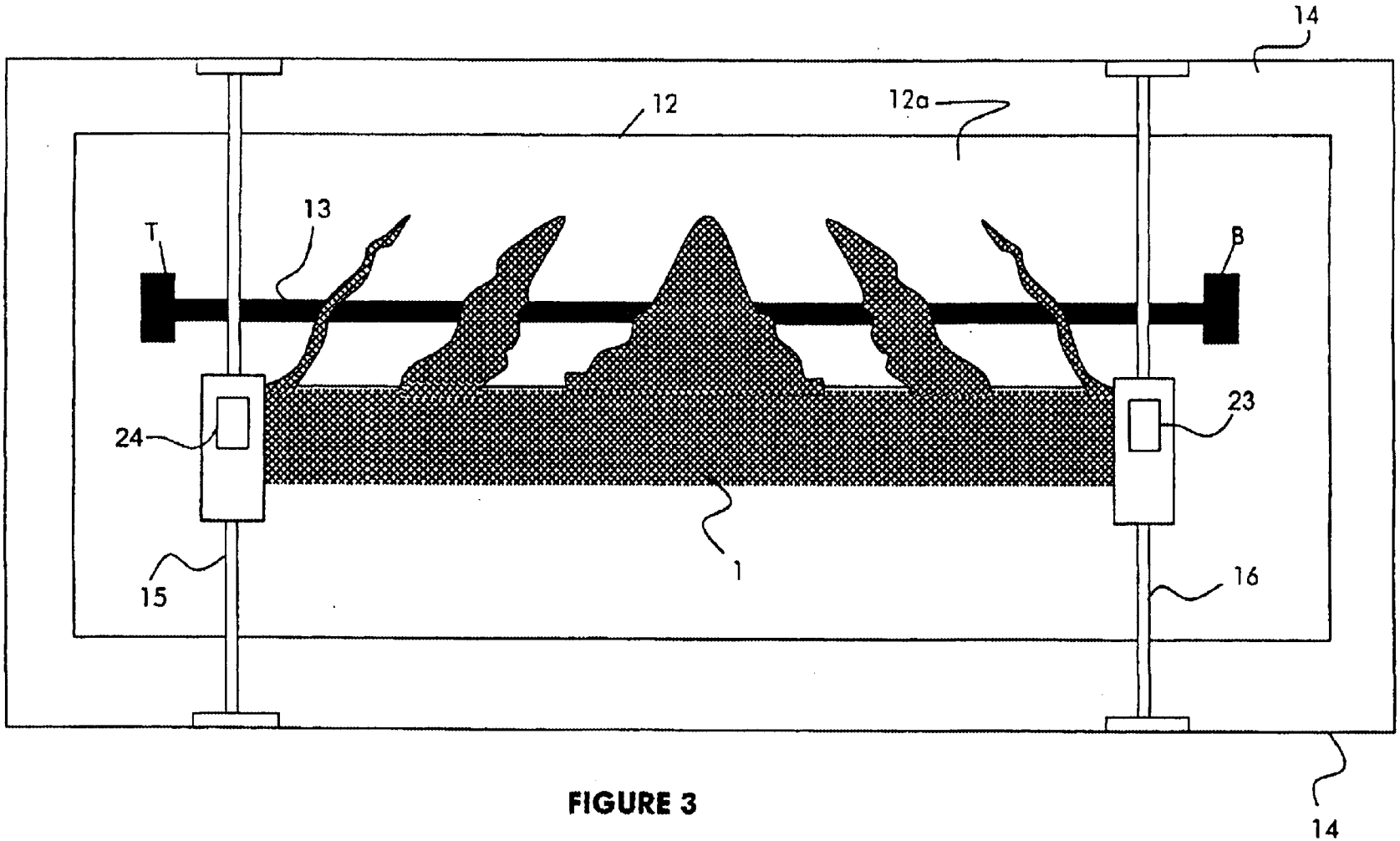
FIG. 3 is a plan view of a phase shifter arrangement incorporating the dielectric element of the present invention.
Figure 4:
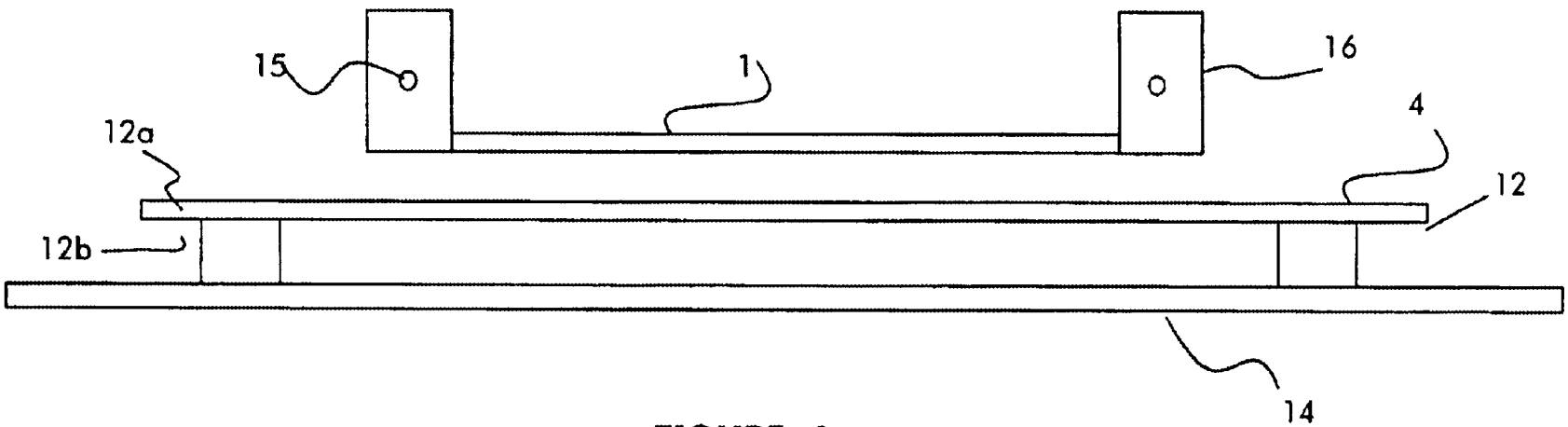
FIG. 4 is a side view of the arrangement shown in FIG. 3.
Figure 8:
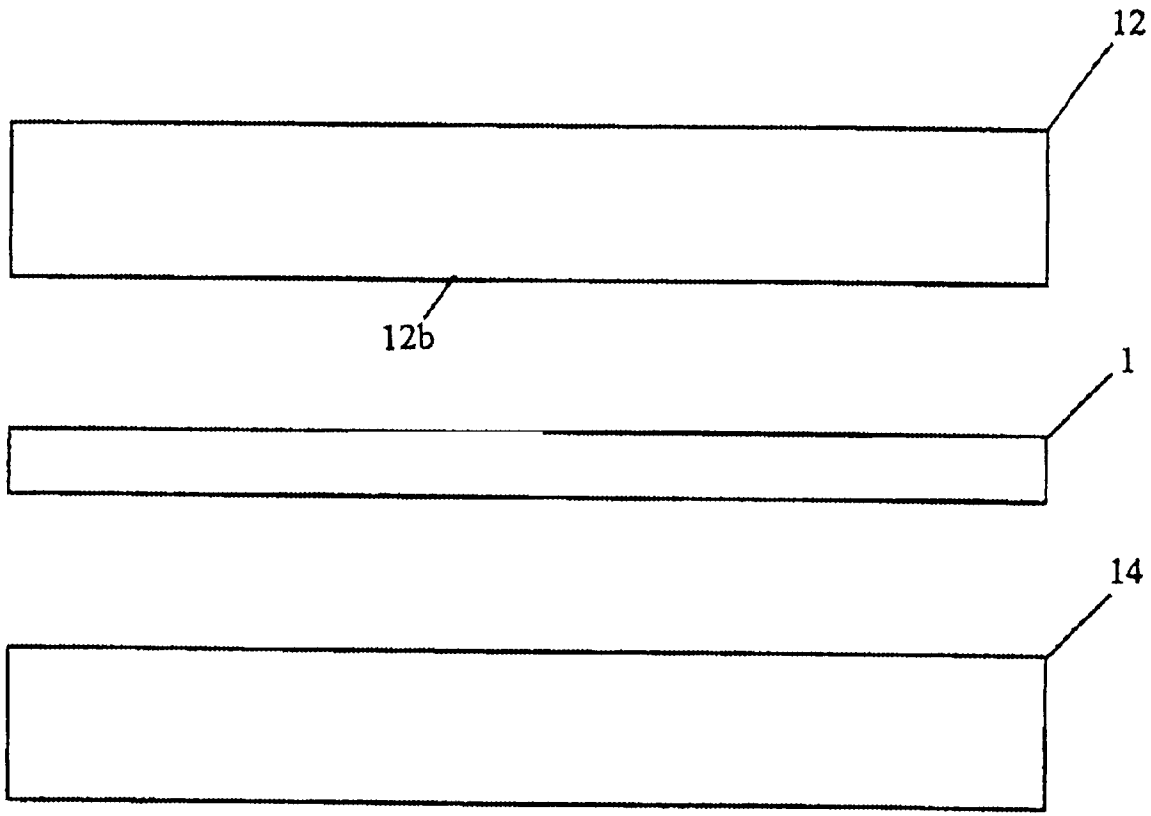
FIG. 8 is a side view of a phase shifter according to the invention, with the movable dielectric 1 disposed between the circuit board 12 and the ground plane 14.

As shown in FIGS. 3 and 4, dielectric element 1 is slidably mounted and adjacent to the top surface of a PCB distribution element comprising a planar dielectric circuit board 12 supporting a conductive track 13 on a first surface 12*a* thereof. The conductive track and the dielectric circuit board form a transmission line whose distal ends terminate at respective terminals T and B. The distribution element is supported in a spaced relationship with a conductive ground plane 14. The dielectric board's second surface 12*b* and the ground plane face one another. Altenately, the second surface of the circuit board and the ground plane can be contiguous (not shown). The movable dielectric element 1 is supported above the first surface 12*a* of circuit board 12 in a linearly slidable manner by two parallel rods 15, 16 attached to the ground plane. It will be understood that the movable dielectric will have the effect of varying the phase whether it is adjacent the first surface 12*a* or the second surface 12*b*, although the phase shift achieved by each arrangement will be different; the movable dielectric element 1 will have a greater effect when adjacent the second surface 12*b*, i.e., interposed between surface 12*b* of circuit board 12 and the ground plane 14 (as shown in FIG. 8).

The greater the number of segments extending from the body section of the element 1, the lesser the aggregate signal reflection caused by the dielectric element. However, the greater the number of segments requires a greater overall length of the element. But the length of the element has to be taken into account when operatively associating the element with an antenna array, to avoid constructional problems. Therefore, the choice of the number of segments is a compromise between electrical performance and practical dimensions.

If, as shown in FIG. 1, the element 1 has five segments (and correspondingly four gaps) then an equivalent electrical circuit comprises nine equivalent transmission line sections in series. For one specific phase shift and desired frequency range, the lengths of those nine elements are adjusted (optimised) by using known commercially available radio frequency circuit analysis and optimisation software, to simultaneously achieve the desired phase shift and minimise the aggregate signal reflection due to the presence of the dielectric segments. The lengths of the equivalent transmission lines then represent the optimum lengths of the dielectric segments, and the optimum width of the gaps, adjacent to or overlapping the physical transmission line conductor for that particular phase shift. The same process is then repeated again and again for different phase shift values desired. Then, to construct the means by which a linear transverse movement of the dielectric element is converted to a variable phase shift, the various lengths of dielectric segments and widths of gaps overlapping the transmission line are joined to produce the required profiles of the segments. From these profiles, information is derived in a known manner and used in suitable numerically controlled cutting equipment to produce the complex shaped segments of the dielectric element.

Figure 5:
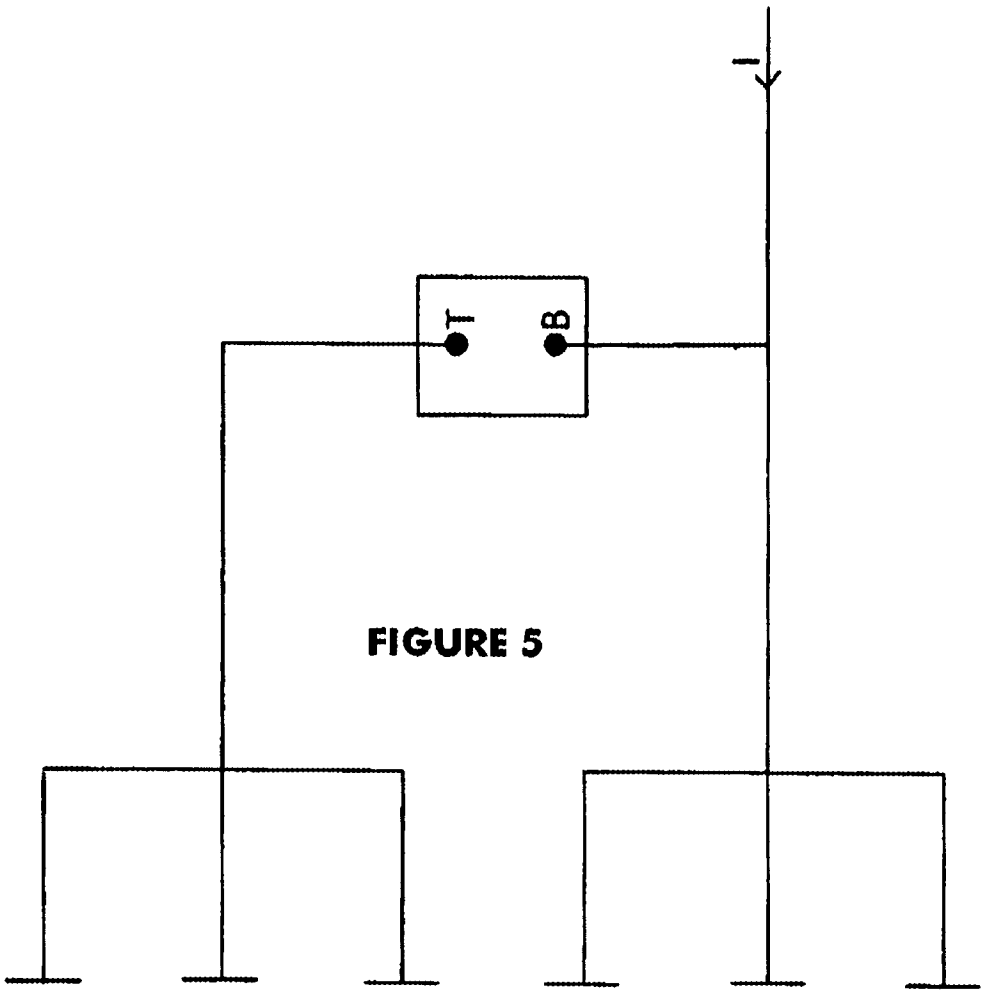
FIG. 5 is a schematic layout of an antenna array incorporating the phase shifter arrangement shown in FIG. 3.
Figure 6:
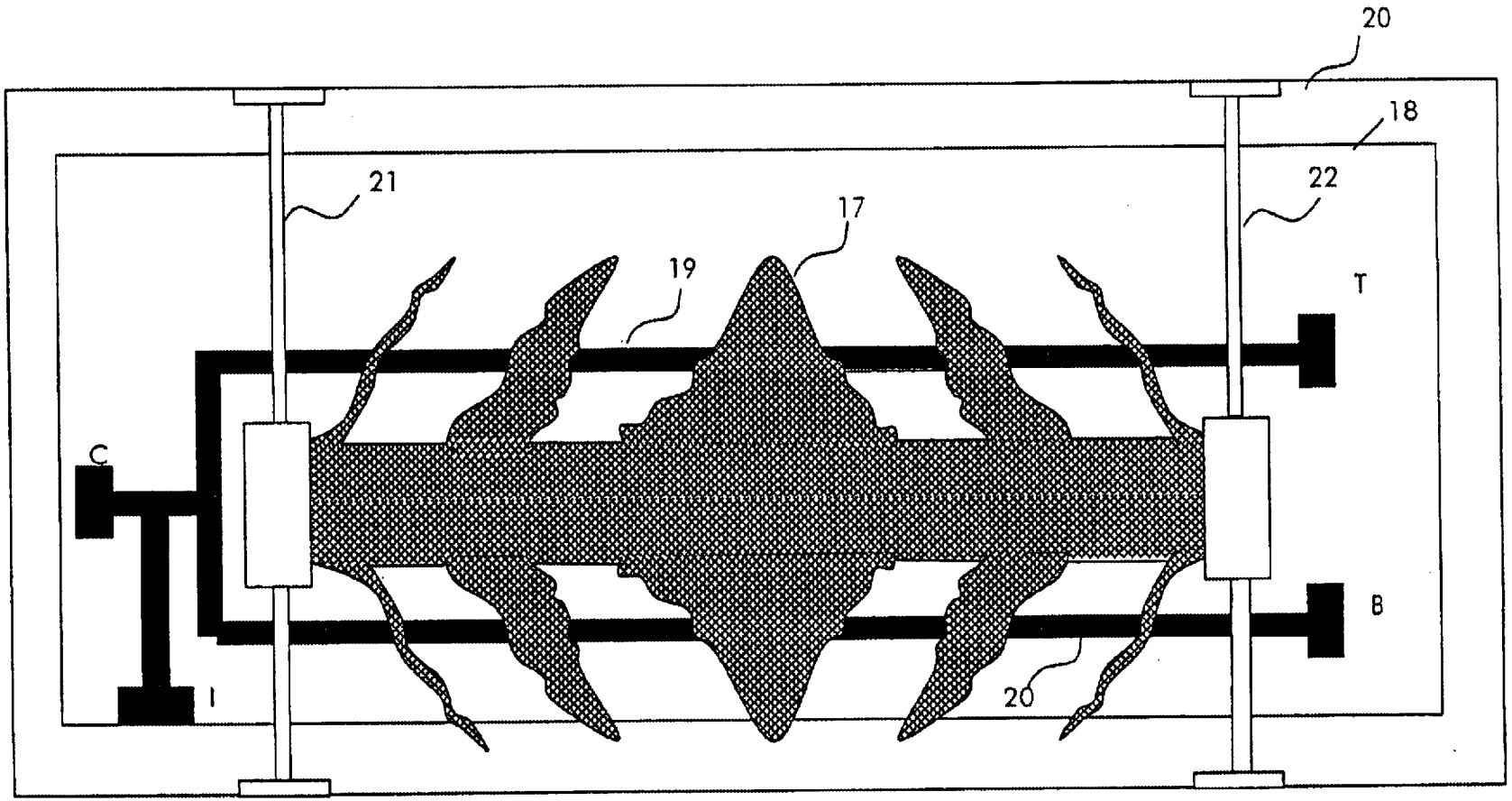
FIG. 6 is a plan view a further embodiment of a phase shifter arrangement incorporating the dielectric element of the present invention.
Figure 7:
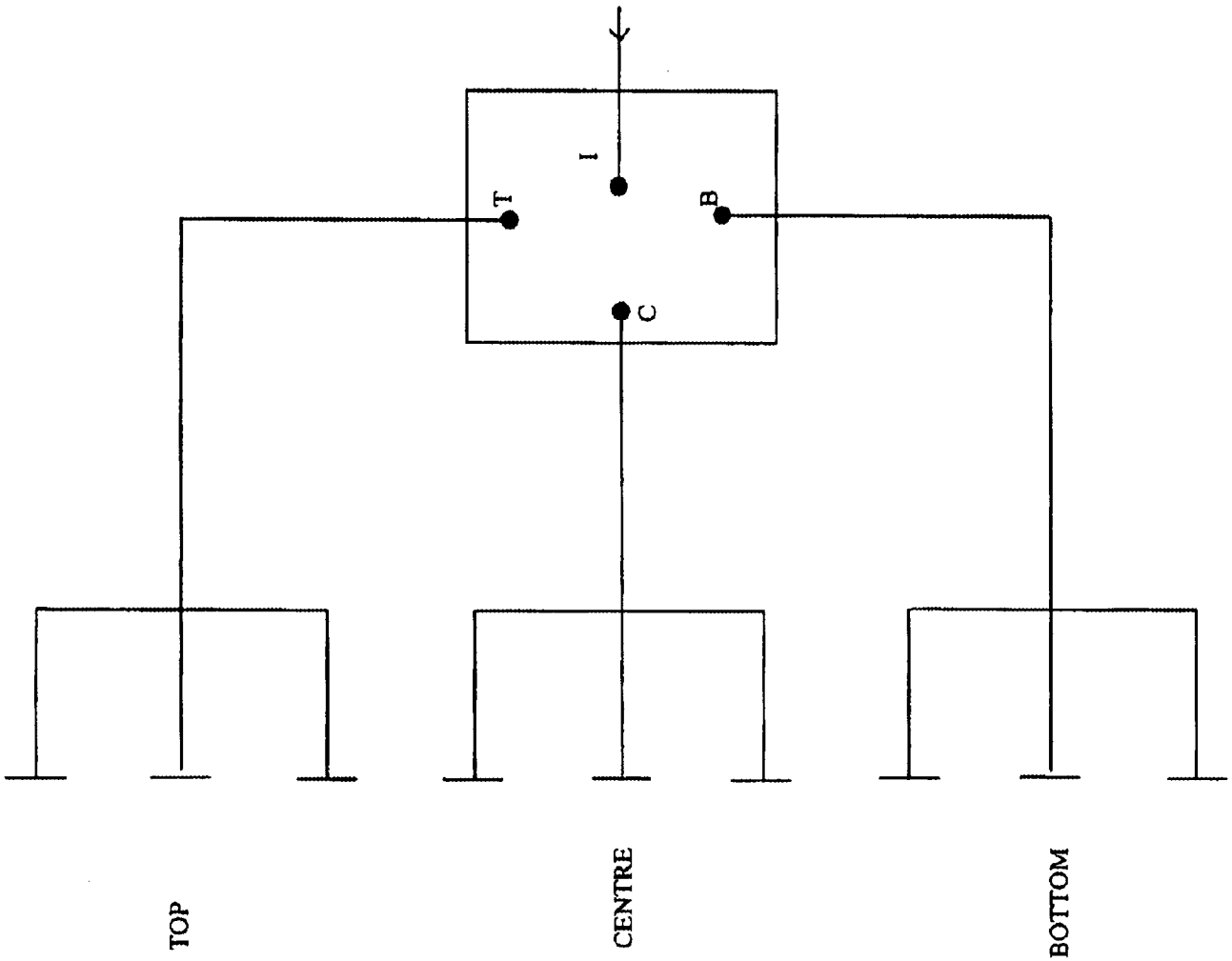
FIG. 7 is a schematic layout of an antenna array incorporating the phase shifter arrangement shown in FIG. 6.

Referring to FIG. 6 of the drawings there is shown a second embodiment of the invention for use with a three section antenna array (see FIG. 7). This is in contrast to FIG. 5 of the drawings which shows a two section antenna array having two terminals T and B and signal input I. The planar dielectric element 17 is provided with segments that extend from opposite major edges of the dielectric element's body section. A movable dielectric element 17 is slidably mounted and adjacent to one surface surface of a planar PCB distribution element 18 that supports two conductive tracks 19 and 20. The conductive tracks and the dielectric circuit board form a transmission network for splitting a radio frequency signal applied to a signal input terminal I (see FIG. 7) into three paths that terminate respectively in three terminals T, B and C for feeding to the Top (T), Bottom (B) and Center(C) sections of a three section antenna array (see FIG. 7). The distribution element 18 is supported in a space relationship with a conductive ground plane 20; the planar dielectric circuit board's other surface and the ground plane facing one another. The movable dielectric element 17 is supported in a linearly slidable manner by two parallel rods 21 and 22 attached to the ground plane 20.

It will be understood that the arrangement by which the dielectric element can be selectively moved in relation to the transmission line to vary the phase of signals is not limited to the preferred arrangement of parallel rods used in the embodiments described in relation to FIGS. 1 and 6. Various known arrangements could be adapted, such as, for example, rotational arrangements. Further, remotely controlled servomechanisms could be adapted to move the dielectric element.

The claims defining the invention are as follows:

1. A phase shifter element and to selectively vary the effective dielectric constant of a section of transmission line thereby changing the propagation velocity of said transmission line and varying the phase of signals of desired frequencies or frequency range passing through said transmission line, said phase shifter element comprising a movable planar dielectric member of predetermined dielectric consant adjacent said transmission line, said planar dielectric member being provided with three or more discrete interactive dielectric segments extending from at least one edge thereof to moveably overlap said transmission line, wherein dimensions of each said interactive segment and widths of gaps defined by opposite edges of adjacent segments are determined by computer optimisation means, such that the aggregate reflection of said signals passing through said transmission line is minimised, wherein at least two of said interactive segments are shaped differently from one another.

2. A phase shifter element as claimed in claim 1, where said gaps are air gaps.

3. A phase shifter element as claimed in claim 1, wherein said gaps are at least partly filled by material whose dielectric constant is different to that of a dielectric constant of said dielectric segments.

4. A phase shifter element as claimed in claim 1, wherein said gaps are at least partly filled by the same material as that of the dielectric segments, and wherein the thickness of the filing is less than the thickness of said segments.

5. A phase shifter element as claimed in claim 1, wherein said optimisation means comprises a radio frequency analysis and optimisation computer program to calculate data for controlling cutting equipment means to produce said dielectric segments having optimum dimensions and optimum widths there between.

6. A phase shifter element as claimed in claim 1, wherein said planar dielectric members comprises a rectangular body section, said dielectric segments extending from a major site thereof, and wherein the segments and the body section lie in the same plane.

7. A phase shifter element as claimed in claim 1, wherein said transmission line is operatively associated with an antenna array.

8. A phase shifter as claimed in claim 7, wherein said transmission line comprises a conductive track of predetermined electrical length supported on has planar dielectric circuit board, said circuit board being mounted in a spaced relationship with a ground plane member.

9. A phase shifter as claimed in claim 8, wherein said movable dielectric member is interposed between said dielectric circuit board and said ground plane member.

10. A phase shifter as claimed in claim 8, wherein said movable dielectric member is disposed above said dielectric circuit board and remote from said ground plane member.

11. A phase shifter as claimed in claim 8, including adjustment means for selectively moving said dielectric element in relation to said transmission line such that said segments and said gaps movably overlap said transmission line to vary the phase of signals passing through said transmission line.

12. A phase shifter as claimed in claim 11, wherein said adjustment means includes a remotely controllable servomechanism.

13. An antenna array incorporating a phase shifter as claimed in claim 1.

14. An antenna array as claimed in claim 13, arranged as a multiple-band antenna array.

15. The phase shifter element of claim 1, wherein said plural interactive dielectric segments include leading and trailing edge surfaces which are nonlinear.

16. A phase shifter element as claimed in claim 1, wherein all of said interactive dielectric segments are of different shapes from one another.

17. A phase shifter element as claimed in claim 1, wherein said gaps are of different shapes from one another.

18. A phase shifter element as claimed in claim 1, wherein the interactive dielectric segments each have leading and trailing edge surfaces along a direction of said transmission line such that at least one of the leading and trailing edge surfaces of at least one interactive dielectric segment is nonlinear.

19. A multi-band antenna system comprising:

a multi-band antenna comprising one or more radiating elements;

a conductive ground plane;

a distribution element comprising a planar dielectric circuit board and conductive tracks, said planar dielectric circuit board and said conductive tracks providing a transmission line network for splitting a signal applied to a signal input terminal into a plurality of paths that terminate at respective one or more radiating elements;

a movable planar dielectric element comprising a body and three or more discrete interactive dielectric segments extending from at least one edge of said body, wherein said movable planar dielectric element movably overlaps said transmission line network so that an aggregate reflection of signal passing through said transmission line network is minimized;

wherein at least two of said interactive segments are shaped differently from one another.

20. The multi-band antenna system of claim 19, wherein the moveable dielectric element is supported in a linear slidable manner by two parallel rods attached to the conductive ground plane.

21. The multi-band antenna system of claim 20, wherein the moveable dielectric element further comprises an adjustable means that includes a remotely controllable servomechanism.

* * * * *